United States Patent [19]

Yoshikawa

[11] Patent Number: 4,622,940

[45] Date of Patent: Nov. 18, 1986

[54] PORTING ARRANGEMENT FOR INTERNAL COMBUSTION ENGINE

[75] Inventor: Masaaki Yoshikawa, Iwata, Japan

[73] Assignee: Yamaha Hatsudoki Kabushiki Kaisha, Iwata, Japan

[21] Appl. No.: 711,978

[22] Filed: Mar. 14, 1985

[30] Foreign Application Priority Data

Mar. 15, 1984 [JP] Japan ..... 59-49899

[51] Int. Cl.[4] ..... F02B 15/00

[52] U.S. Cl. ..... 123/432; 123/52 MC; 123/188 M

[58] Field of Search ..... 123/308, 432, 52 MC, 123/188 M

[56] References Cited

U.S. PATENT DOCUMENTS 3,408,992 11/1968 Von Seggern et al. ..... 123/52 M

FOREIGN PATENT DOCUMENTS 18553 11/1982 Japan ..... 123/308

*Primary Examiner*—E. Rollins Cross

*Attorney, Agent, or Firm*—Ernest A. Beutler

[57] ABSTRACT

A porting and valve arrangement for an internal combustion engine embodying three valves serving the same chamber. Separate passages extend from each of the valves and merge into a common symmetrical portion for facilitating good distribution and cooperation with an associated manifold or the like.

4 Claims, 5 Drawing Figures

PORTING ARRANGEMENT FOR INTERNAL COMBUSTION ENGINE

BACKGROUND OF THE INVENTION

This invention relates to a porting arrangement for internal combustion engines and more particularly to an improved porting arrangement for engines having multiple values.

With internal combustion engines, the advantages of utilizing plural valves per combustion chamber are well known. By using plural valves, it is possible to achieve a greater flow area for a given surface area than with the use of single, large valves. In addition, the use of a greater number of smaller valves permits the engine to run at higher speeds since the inertia of the valve elements is considerably lighter than with single large valves. One problem, however, with the use of multiple valve engines is the accommodation of the individual passages leading to the valves with the mating component. For example, if multiple intake passages are employed, it is either necessary to use a like multiple number of intake manifold passages or, alternatively, the passages must be "siamesed" in some manner. Although siamesing is a common practice in connection with the use of two intake passages or two exhaust passages, it has not been possible to provide effective merger of more than two passages with each other without causing some flow restriction or uneven flow through the respective passages.

It is, therefore, a principal object of this invention to provide an improved porting and passage arrangement for an internal combustion engine.

It is a further object of this invention to provide an improved porting arrangement for engines having three or more valves served by individual passages that merge into a common portion.

SUMMARY OF THE INVENTION

This invention is adapted to be embodied in a valve and porting arrangement for the combustion chamber of a four-cycle internal combustion engine having at least three separate valve seats communicating with the combustion chamber. Valve means control the flow through the valve seats and at least three passages extend separately from respective of the valve seats. The passages all merge into a single passage that extends to an outer face of the component of the engine in which the passages are formed. The single passage has a generally symmetrical configuration at its opening.

DETAILED DESCRIPTION OF THE PREFERRED EMBODIMENT

Figure 1:
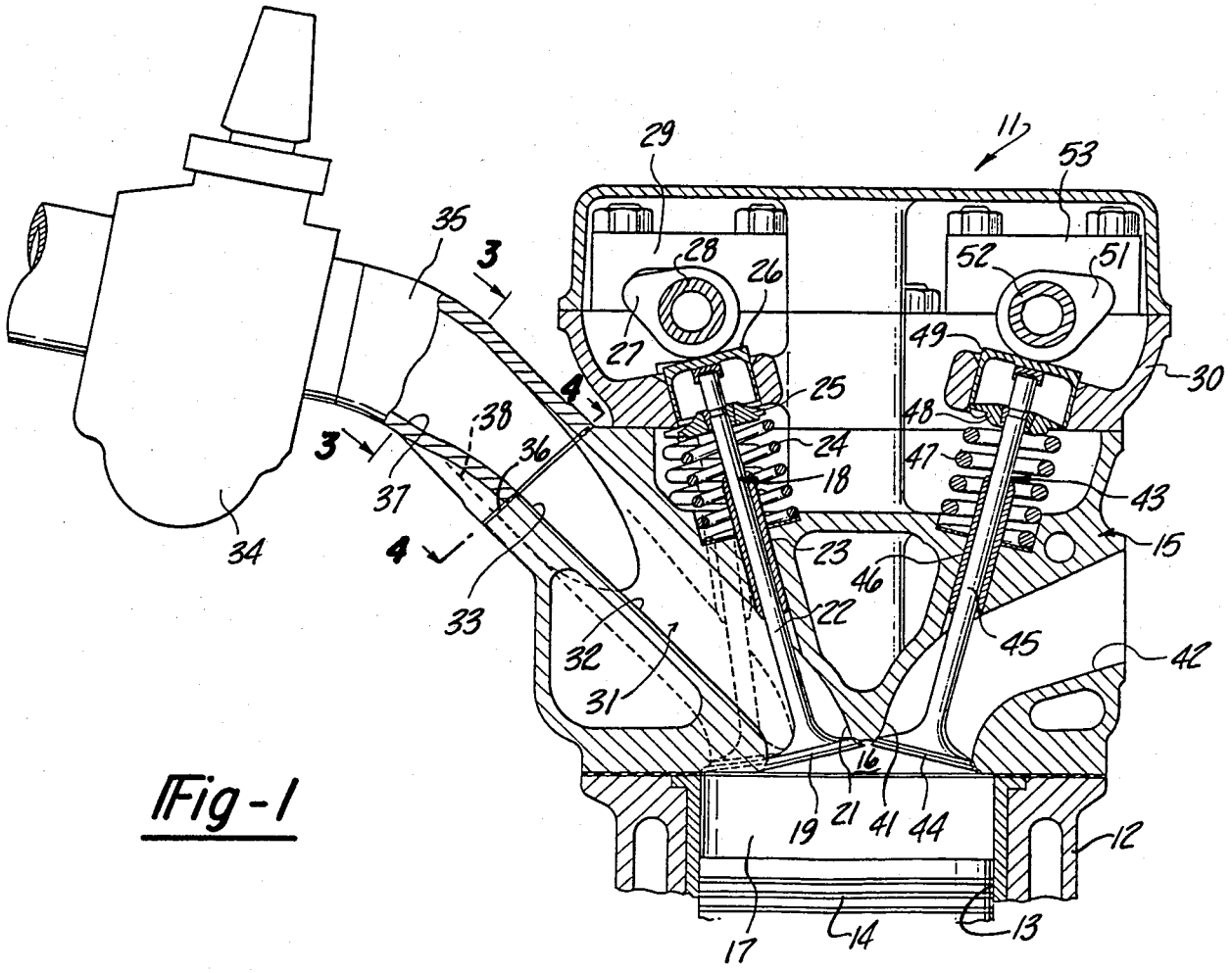
FIG. 1 is a cross-sectional view taken through the single cylinder of an internal combustion engine constructed in accordance with an embodiment of the invention.

Referring now in detail to the drawings and first primarily to FIG. 1, an internal combustion engine constructed in accordance with the invention is identified generally by the reference numeral 11. Since the invention relates primarily to the valve mechanism and porting arrangement, only this portion of the engine has been shown in detail by reference to a single cylinder. It is believed to be obvious to those skilled in the art how the remainder of the engine is constructed as well as the fact that the invention may be applied to engines having more than one cylinder and varying cylinder formations such as inline, V type or opposed.

The engine 11 includes a cylinder block 12 formed with a cylinder bore 13 in which a piston 14 is supported for reciprocation. As is well known, the piston 14 is connected to an output shaft by means of a connecting rod (not shown).

A cylinder head, indicated generally by the reference numeral 15, is affixed to the cylinder block 12 in a suitable manner and has a recess 16 that cooperates with an area 17 above the head of the piston 14 and within the cylinder 13 so as to provide a chamber of varying volume. This chamber will, at times, be referred to as the combustion chamber.

The engine 11 is provided with a plurality of, and in the illustrated embodiment, three intake valves 18 having respective valve heads 19 that cooperate with valve seats 21 formed in the cylinder head 15 and specifically in the cavity 16. The intake valves 19 have respective valve stems 22 that are slidably supported in guides 23 pressed into the cylinder head. The valves 18 may be disposed in an orientation in the manner as described in application Ser. No. 369,665, filed Apr. 19, 1982 entitled "Four-Cycle Engine" and assigned to the assignee of this application, so as to provide the advantages of such placement as noted in that application.

Coil springs 24 encircle the individual valve stems 22 and act against keepers 25 for urging the valves 18 to their closed positions.

The valves 18 are opened by means of thimble tappets 26 that are slidably supported in suitable bores formed in a cam tower 30 that is affixed to the cylinder head 15. The thimble tappets cooperate with the tips of the valve stems 22 and are actuated by respective lobes 27 of a camshaft 28. The camshaft 28 is driven in timed sequence with the output shaft, in a known manner, and is journaled in the cam tower 30 by bearings formed in it and by bearing caps 29 that are fixed to the cam tower 30 in a suitable manner.

Figure 2:
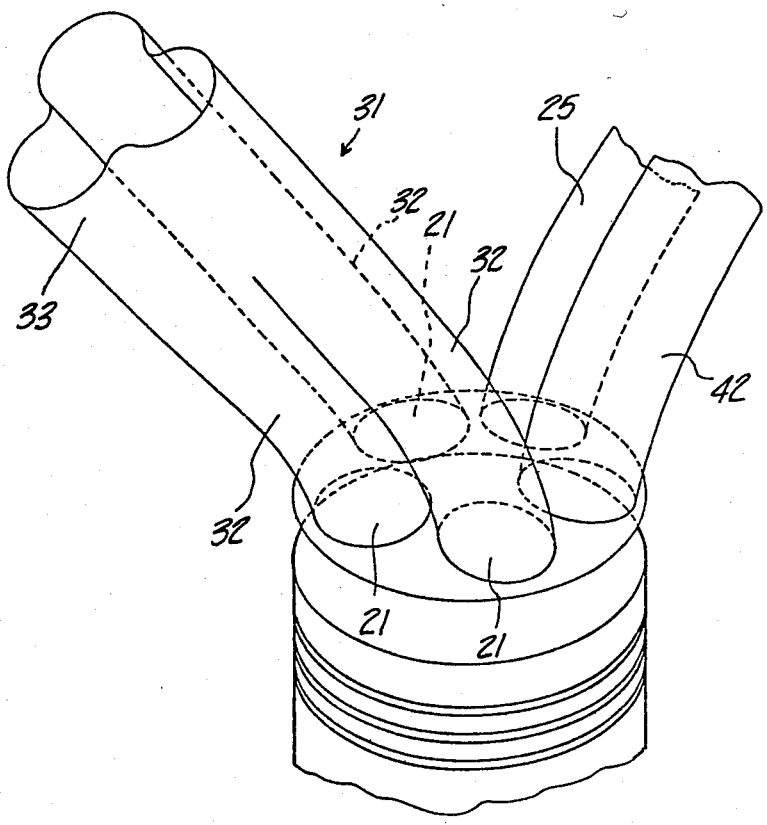
FIG. 2 is a schematic view in perspective form showing the configuration of the passages.
Figure 3:
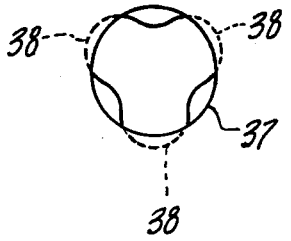
FIG. 3 is a cross-sectional view taken along the line 3—3 of FIG. 1.
Figure 4:
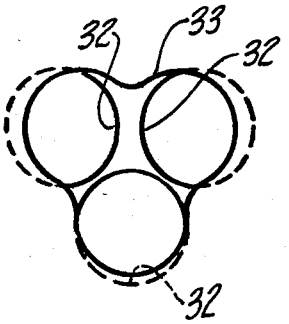
FIG. 4 is a cross-sectional view taken along the line 4—4 of FIG. 1.
Figure 5:
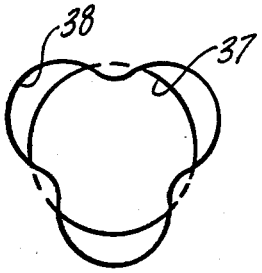
FIG. 5 is a cross-sectional view taken along the line 5—5 of FIG. 1.

An induction passage system, indicated generally by the reference numeral 31 and shown in most detail in FIGS. 2 and 4 is provided for delivering a charge to the chamber 16 through the valve seats 21 when the intake valves 18 are opened. This system is comprised of three individual runners or passages having a generally circular cross-sectional configuration 32 that merge into a common section 33 that has a generally symmetrical shape about its center axis and which has a shape that approximates a three leaf clover. By merging into this shape, it is possible to provide a relatively simple inlet, as will be described, and equal distribution to all of the passages 32 is assured.

A carburetor 34 is attached to an intake manifold 35 and delivers a charge to the inlet opening of the passage 33 which is formed in a face 36 of the cylinder head 15.

The intake manifold 35 has a first, generally circular cross-sectional area portion 37 that receives the charge from the carburetor and which merges into a section 38 that is generally complementary in shape to the shape of the inlet end of the cylinder head portion 33 so as to insure good flow and equal flow distribution.

A spark plug (not shown) is supported in the cylinder head 15 with its gap extending into the chamber 16 for firing the charge.

The burnt charge is discharged from the chamber 16 past exhaust valve seats 41 into cylinder head exhaust passages 42. The exhaust passages 42 may have either a common outlet or individual outlets that cooperate with an associated exhaust manifold (not shown) for discharge to the atmosphere.

Exhaust valves, indicated generally by the reference numeral 43, are provided that have heads 44 that cooperate with the valve seats 41 for controlling the flow through these seats. The exhaust valves 43 have individual stems 45 that are slidably supported in guides 46 pressed into the cylinder head 15. Coil compression springs 47 encircle the valve stems 45 and act against keepers 48 to urge the exhaust valves 43 toward their closed positions.

The exhaust valves 43 are opened by means including thimble tappets 49 that are slidably supported in suitable bores in the valve tower 30.

The thimble tappets 49 are actuated by lobes 51 formed on an exhaust camshaft 52. The exhaust camshaft is driven from the engine output shaft in a known manner and is journaled in the cam tower 30 by means including bearing caps 53 that are affixed to the cam tower 30 in a suitable manner.

It should be readily apparent that the described construction permits the use of plural valves and specifically three or more valves having a single inlet that will assure good distribution to all of the passages. Although the invention has been described in conjunction with three intake valves, it should be readily apparent to those skilled in the art that the invention is also susceptible of use with engines having three or more exhaust valves. In such cases, the outlet end will have a suitable configuration to merge with the associated inlet to the exhaust manifold. For example, the shape can be the same as the shapes described in conjunction with the inlet system.

Although an embodiment of the invention has been illustrated and another embodiment described, various other changes and modifications may be made without departing from the spirit and scope of the invention, as defined by the appended claims.

I claim:

1. A valve and porting arrangement for the combustion chamber of a four-cycle internal combustion engine having at least three separate valve seats communicating with said combustion chamber, valve means for controlling the flow through said valve seats, and at least three passages extending separately from respective of said valve seats, said passages merging smoothly into a single passage extending to and having only a single inlet opening formed on an outer face of the component of the engine in which said passages are formed, said single passages having a generally symmetrical, non-circular configuration.

2. A valve and porting arrangement as set forth in claim 1 wherein the component of the engine comprises a cylinder head.

3. A valve and porting arrangement as set forth in claim 2 wherein the individual portions of the passages have generally circular cross-sectional configurations.

4. A valve and porting arrangement as set forth in claim 3 wherein the single passage has a cross-sectional configuration of a three leafed clover.

* * * * *